United States Patent [19]

Bordeaux

[11] 4,399,578

[45] Aug. 23, 1983

[54] TOOL FOR CLEANING BATHTUB

[76] Inventor: Willard A. Bordeaux, 4001 E. McDowell, Apt. 144, Phoenix, Ariz. 85008

[21] Appl. No.: 295,112

[22] Filed: Aug. 21, 1981

[51] Int. Cl.[3] ..... A47L 25/00; A46B 13/02

[52] U.S. Cl. ..... 15/97 R; 15/24; 15/230

[58] Field of Search ..... 15/23, 24, 28, 29, 97 R, 15/144 R, 49 R, 50 R, 98; 51/177

[56] References Cited

U.S. PATENT DOCUMENTS

| | | | |
|---|---|---|---|
| 2,154,564 | 4/1939 | Eisenlohr | 15/49 R X |
| 2,397,537 | 4/1946 | Coss | 15/144 R X |
| 2,702,395 | 2/1955 | Zaiger | 15/98 |
| 3,102,294 | 9/1963 | Miller et al. | 15/97 R |
| 3,105,987 | 10/1963 | Riedi | 15/98 |
| 3,236,985 | 2/1966 | Ernolf | 15/49 R X |
| 3,387,312 | 6/1968 | Westphal | 15/97 R |
| 3,431,573 | 3/1969 | Frandsen | 15/98 |
| 4,208,753 | 6/1980 | Lewis | 15/29 |
| 4,217,671 | 8/1980 | Rand | 15/29 X |

*Primary Examiner*—Edward L. Roberts

*Attorney, Agent, or Firm*—Drummond, Nelson & Nissle

[57] ABSTRACT

A tool for cleaning a bathtub. The tool enables an individual standing adjacent a bathtub to readily reach and clean the inner vertical and horizontal surfaces of the bathtub. The tool comprises a cleaning head and an elongate handle shaped, contoured and dimensioned to allow the application of the cleaning head to bottom and side surfaces of the bathtub. The handle is attached to the cleaning head generally at the center of gravity thereof to facilitate the control and positioning of the cleaning head during utilization of the tool. The cleaning head includes a rotary circular pad for contacting and cleaning the surfaces of the bathtub and a motor for supplying motive power to drive the circular pad. The circular pad is resiliently compressible to facilitate the adaptation of the cleaning head to the various curved surfaces of the bathtub.

9 Claims, 8 Drawing Figures

TOOL FOR CLEANING BATHTUB

This invention relates to apparatus for cleaning and maintaining a bathtub.

More particularly, the invention pertains to a bathtub-cleaning tool which permits the inner surfaces of a bathtub to be cleaned by an individual standing next to the bathtub.

In another respect, the invention pertains to a lightweight cleaning tool which is readily manually manipulated to remove dirt and grime from flat or contoured horizontal or vertical surfaces of a residential bathtub.

The periodic cleaning of bathtubs is a universal disliked homekeeping task which normally requires and individual's getting down on hands and knees to manually scour bathtub surfaces. This time-honored procedure for cleaning a bathtub is awkward at best, and, for many physically handicapped individuals, particularly the elderly or those suffering from arthritis or from an injured back, the kneeling and bending required makes scouring a bathtub a prohibitively difficult task to perform.

Although an easy-to-use tool specifically adapted to effectively clean a bathtub and probably meet with wide acceptance, developing a tool which would overcome various problems associated with the cleaning of a bathtub is difficult. For instance, the tool should be able to clean both the horizontal bottom surface and the vertical side surfaces of a bathtub and, would preferably enable an individual to reach all of the inner bathtub surfaces while standing next to the bathtub. Such a cleaning tool should also be lightweight and well-balanced so that the user of the tool could easily manipulate and control the tool during the use thereof.

Accordingly, it would be highly desirable to provide a lightweight, easily manipulated tool which could be utilized by an individual standing next to a bathtub to reach and clean all of the inner surfaces of the bathtub.

Therefore, it is the principal object of the invention to provide a tool specially adapted to clean the inner surfaces of residential bathtubs.

Another object of the invention is to provide a bathtub-cleaning tool which would be lightweight and could be easily manipulated to clean both the horizontal and vertical inner surfaces of a residential bathtub.

A further object of the invention is to provide a bathtub-cleaning tool which would include an elongate handle and a cleaning head attached to one end of the handle and in which the center of gravity of the tool is located along the middle portion of the handle to facilitate the handling of the tool during cleaning of a bathtub.

Still another object of the invention is to provide a bathtub-cleaning tool of the type described in which the cleaning head of the tool could be readily adjusted with respect to the handle so that the tool could be easily adapted for cleaning both the bottom and the sides of a bathtub.

Yet another object of the invention is to provide a bathtub-cleaning tool having a cleaning head which could alternately be utilized to clean the flat or the contoured surfaces of a bathtub.

These and other, further and more specific objects and advantages of the invention will be apparent to those skilled in the art from the following detailed description thereof, taken in conjunction with the drawings, in which.

Figure 1:
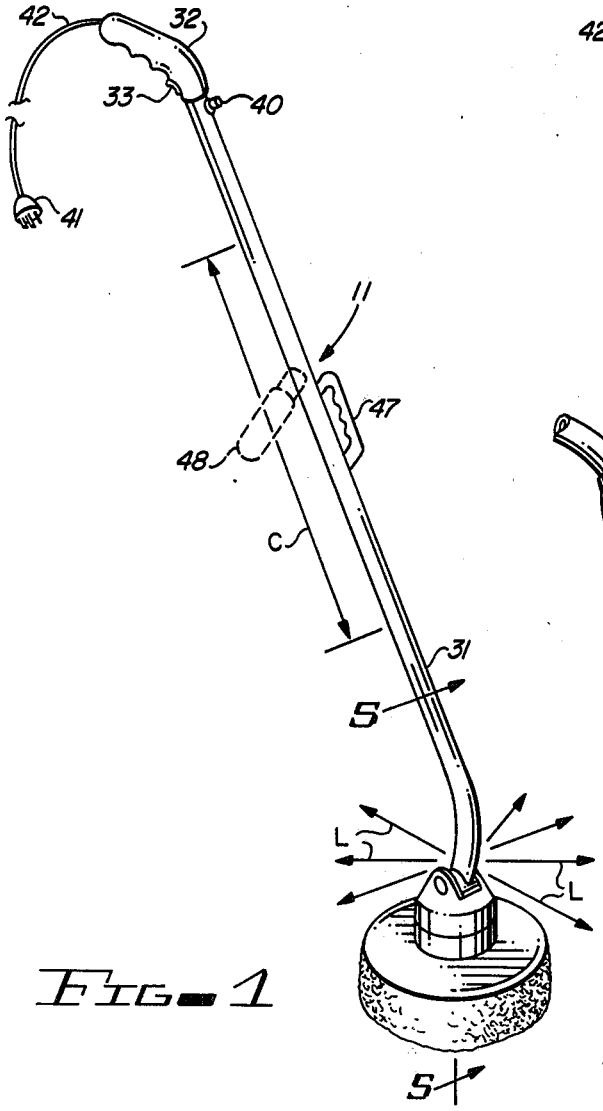
FIG. 1 is a perspective view of a cleaning tool constructed in accordance with the present invention.

Briefly, in accordance with my invention, I provide a tool for cleaning a bathtub. The tool enables an individual standing adjacent the bathtub to readily reach and clean the vertical and horizontal surfaces thereof. The tool includes a cleaning head comprising a rotary circular pad for contacting and cleaning the surface of the bathtub and, a motor for supplying motive power to drive the rotary circular pad and having a depending rotatable member for carrying and imparting motive power to the pad; and an elongate handle shaped, contoured and dimensioned to allow the application of the cleaning head to the bottom and side surfaces of the bathtub by an individual grasping the handle and standing alongside the bathtub. The handle is attached to the cleaning head generally at the center of gravity thereof to facilitate the control and positioning of the cleaning head during utilization of the tool. The rotary circular pad is resiliently compressible to facilitate the adaptation of the cleaning head to the curved surfaces of the bathtub.

Turning now to the drawings, which depict the presently preferred embodiments of the invention for the purpose of illustrating the practice thereof, and not by way of limitation of the scope of the invention, and in which like reference characters indicate corresponding elements throughout the several views, FIGS. 1, 2, 5 and 6 illustrate the presently preferred embodiment of the invention including a handle and cleaning head assembly generally indicated by reference characters 11 and 12, respectively. Motor 13 of cleaning head assembly 12 rotates depending shaft 14 to transmit motive power to circular flexible rubber support pad 15. Externally treated screw 16 and washer 17 detachably fixably secure rubber pad 15 to rotary shaft 14. Aperture 21 formed in pad 15 receives screw 16 and washer 17. Hemispherical foam rubber sponge 18 and cloth cover 19 of cleaning pad 23 are attached to circular rubber panel 20 which is secured to rubber pad 15 by adhesive 22. When cleaning pad 23 is worn and requires replacement, replacement adhesive layer 22 can be peeled off support pad 15. After protective paper sheet 43 is removed, adhesive surface 22 of the new cleaning pad is pressed against rubber pad 15. Since foam sponge 18 is resiliently compressible and rubber pads 15, 20 are pliant, cleaning pad 23 can readily adapt to and travel across the curved inner surfaces of a bathtub.

Elongate hollow tubular member 31 of handle 11 is attached at its lower end to rod 30 having internally threaded apertures 29. Upwardly depending ears 26 of motor housing 25 have apertures 27 formed therein to receive externally threaded screws 28 which are turned into apertures 29 of member 30 so that ears 26 and, consequently, housing 25 can rotate about screws 28. Handle 32 provided at the upper end of member 31 includes cable control lever 33. When lever 33 is depressed cable 34 is upwardly drawn through the interior of member 31 and nose 35, which is attached to the lower end of cable 34, is upwardly displaced against spring 36 and disengaged from contact with one of notches 24 formed in housing 25. Cleaning head assembly 23 can be rotated about screws 28 when nose 35 is disengaged from notches 24. After lever 33 is released spring 36 forces nose 35 back into one of openings 24 to facilitate securing cleaning head 12 with respect to handle 11. Spring 36 and nose 35 are of greater width than and cannot be drawn into cylindrical aperture 36 when lever 33 is depressed. Closing switch 40 in handle 31 permits electricity delivered to plug 41 to flow through conduit 42 to power motor 13.

Figure 5:
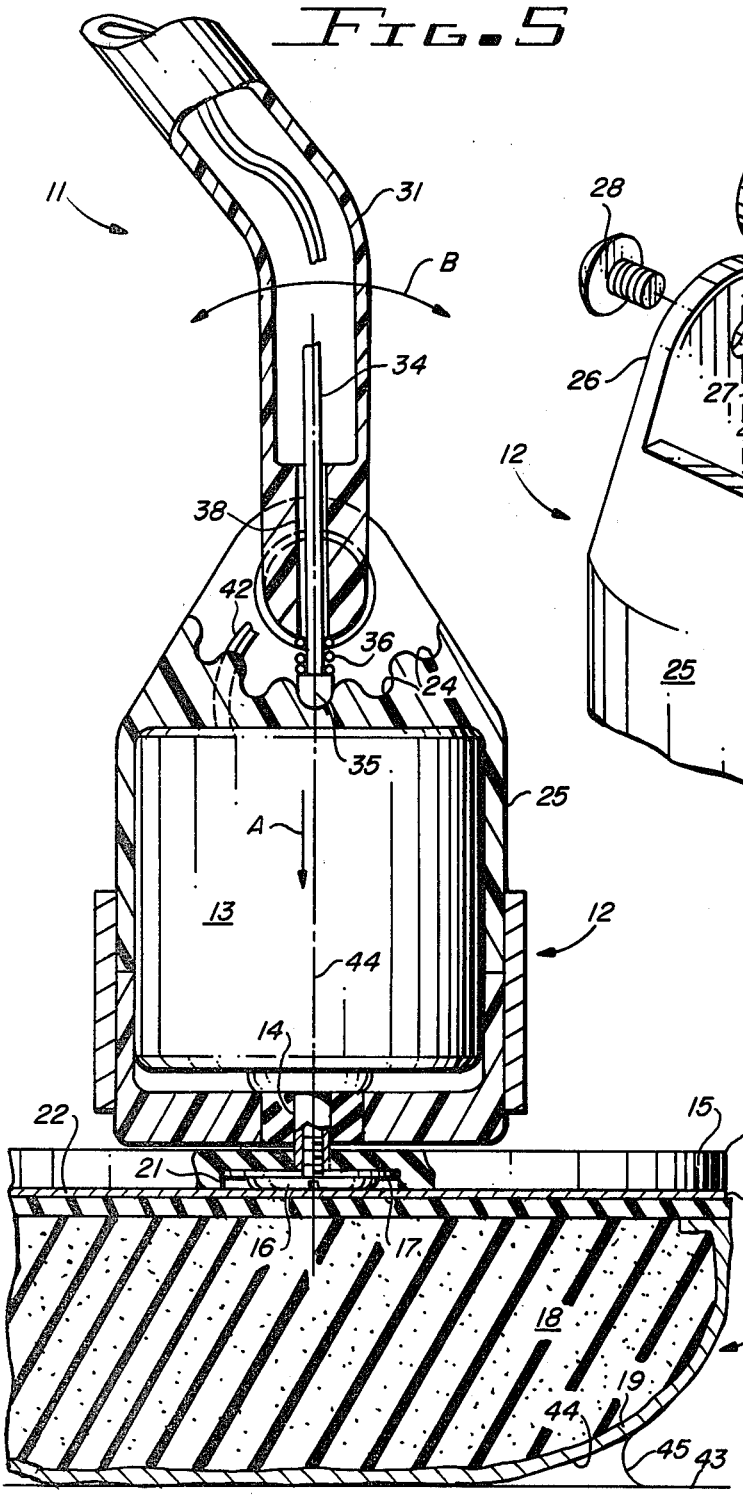
FIG. 5 is an enlarged cross-sectional view of the cleaning head and lower handle portion of the tool of FIG. 1 taken along section line 5—5.

Handle 11 is attached to cleaning head 12 generally at the center of gravity of cleaning head 12, i.e., at a point on the top of head 12 which lies along vertical center line 44 in FIG. 5. Arrow A represents the resultant of all the forces of gravity acting on the various points of cleaning head 12. I have discovered that connecting handle 11 to cleaning head 12 at the center of gravity thereof facilitates control of head 12 and is crucial to being able to readily utilize the tool to clean both the horizontal and vertical surfaces of a bathtub. If handle 11 were connected to head 12 at a point C on the periphery of head 12 (see FIG. 5), in the manner of conventional slow cleaning machines, applying head 12 to vertical surface of a bathtub would, at best, be awkward.

Figure 6:
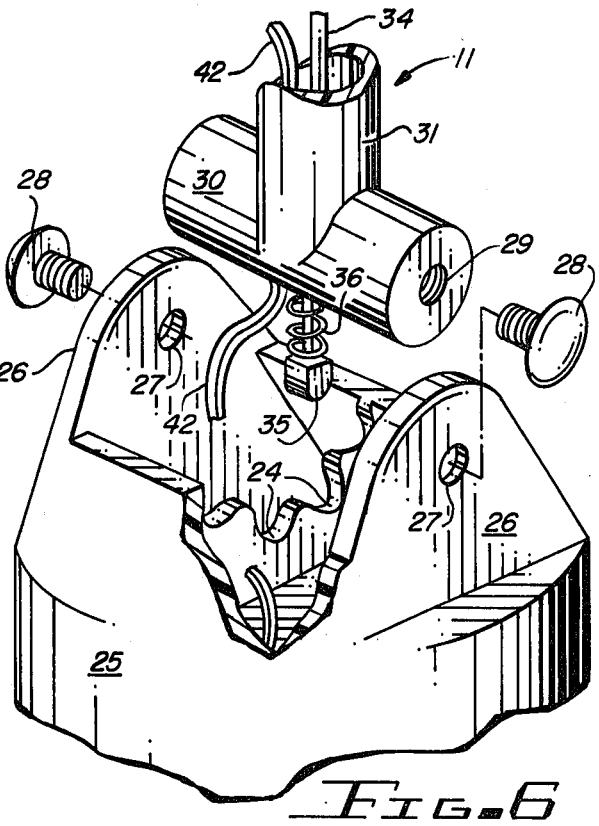
FIG. 6 is a perspective view illustrating the mechanism which adjustably interconnects the handle and cleaning head of the tool of FIG. 1.

Similarly, since a bathtub inludes different sloped surfaces, being able to quickly adjust head 12 with respect to handle 11 is also critical in providing a tool which enables an individual standing next to a bathtub to successfully clean the bathtub. In this regard, lever 33 permits rapid adjustment of the relative position of handle 11 with respect to cleaning head 12. As shown in FIGS. 5 and 6, when lever 33 is depressed handle 11 cannot be rotated in the directions indicated by arrows B. Handle 11 could also be connected to cleaning unit 12 so that handle 11 could be rotated in all lateral directions with respect to unit 12. For instance, if a universal joint or a ball joint mechanism was utilized to interconnect handle 11 and unit 12, handle 11 could, as shown in FIG. 1, be rotated in any lateral direction L with respect to unit 12. If handle 11 could be adjusted in all lateral directions L, a system for locking unit 12 in place in relation to handle 11 could be used which was similar to the locking mechanism illustrated in FIGS. 5 and 6. Nose 35 and notches 28 would be hemispherical in shape and notches 24 would be dispersed over a concave surface formed between ears 26. Numerous other mechanical systems could, of course, be utilized to adjustably lock unit 12 in various fixed positions with respect to handle 11.

Cleaning pad 23 is preferably of relatively small size, 3" to 6" in diameter, so that the bathtub surface area contacted by, and the frictional forces generated by, pad 23 are small and a motor 13 of only limited power is required to rotate rubber pad 15.

After being depressed, lever 33 can be temporarily locked in position so that nose 35 is maintained in the retracted position shown in FIG. 6 without the tool's user having to continually depress lever 33. When nose 35 is disengaged from notches 24, unit 12 is free to automatically adjust to changing bathtub surface contours by rotating in the directions shown by arrows B in FIG. 5.

During operation of the cleaning tool of the invention, centrifugal forces generated by rotary pad 23 tend to cause water and abrading particles to be flung out from pad 12 and against surrounding surfaces. In addition to providing a motor 13 which rotates pad 15 at a low R.P.M., the hemispherical shape of pad 23 minimizes such splattering by creating a narrow gap 44 between pad 23 and bathtub surface 43. As illustrated in FIG. 5, capitllary action tends to draw in and maintain water 45 in gap 44.

Figure 3:
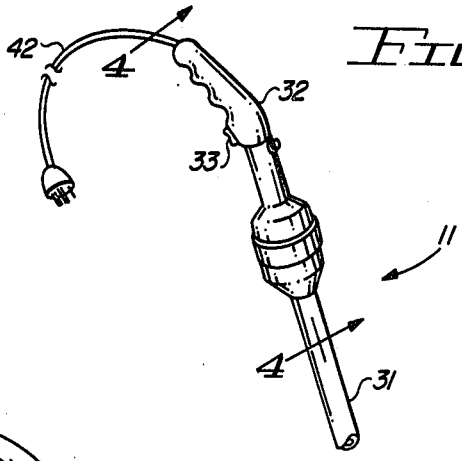
FIG. 3 is a perspective view illustrating another embodiment of the invention.
Figure 2:
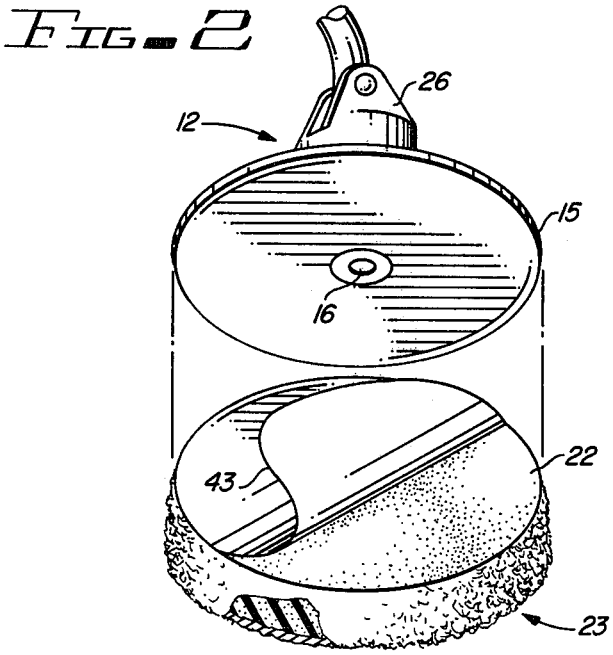
FIG. 2 is a perspective assembly view of the cleaning head of the tool of FIG. 1.
Figure 4:
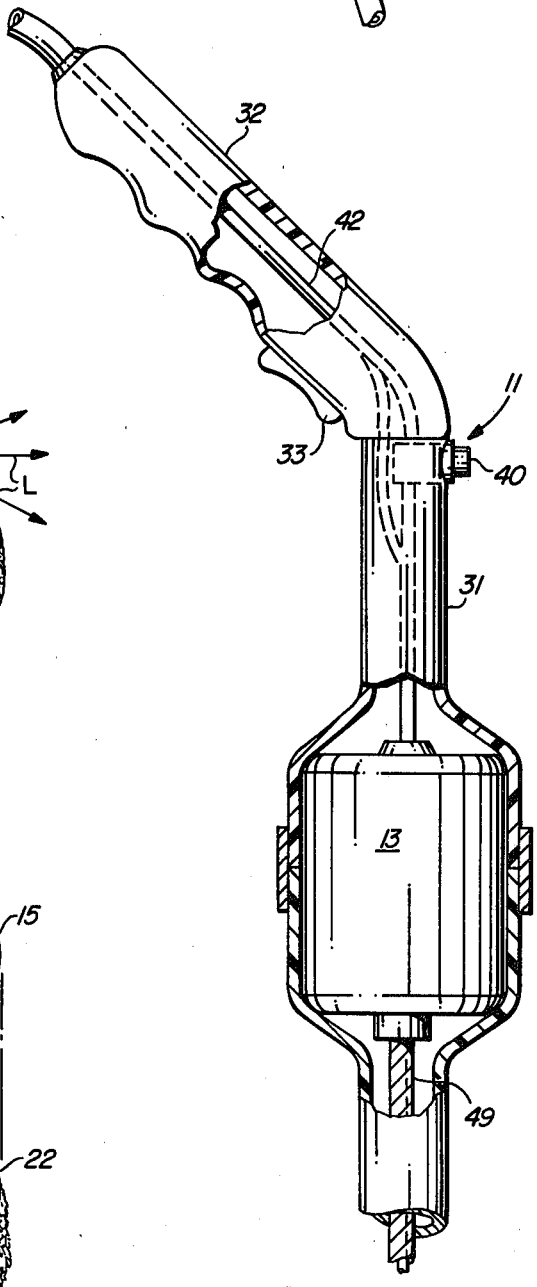
FIG. 4 is a partial section view of the tool handle of FIG. 3 taken along section lines 4—4 thereof and showing further interior construction details thereof.

The cleaning tool of FIG. 1 is balanced so that the overall center of gravity of the tool lies along the middle section of handle 11. The middle section of handle 11 is approximately represented by arrows C of FIG. 1. If necessary, additional weight is added to handle 32 so that the upper portion of member 31 is approximately equal in weight to the lower portion of member 31 and attached cleaning unit 12. Properly balancing the cleaning tool is particularly important because it markedly increases the ease with which the tool can be manipulated. If the was "head heavy", applying pad 23 to the vertical surfaces of a bathtub would be very awkward. If the tool is properly balanced, handle 47 or 48 functions as a fulcrum when the tool is picked up thereby, and the position of the cleaning head 12 can be adjusted by lightly deflecting handle 32 in the desired direction. The alternate embodiment of the cleaning tool depicted in FIGS. 3 and 4 simplifies balancing the tool by positioning motor 13 in handle 11. The weight of motor 13 tends to offset the weight of the remaining embodiments of cleaning head 12 so that additional weight does not have to be added to the upper end of member 31 to balance the tool. When motor 13 is located in handle 11, flexible driveshaft 49 delivers motive power to rubber plate 15.

Figure 7:
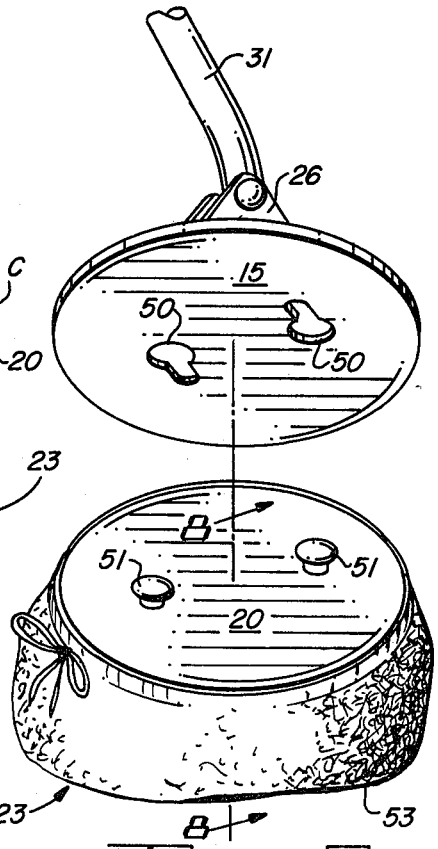
FIG. 7 is a perspective assembly view illustrating an optional method of attaching the cleaning pad to the tool; and, FIG. 8 is a sectional view of the cleaning pad of FIG. 7.
Figure 8:
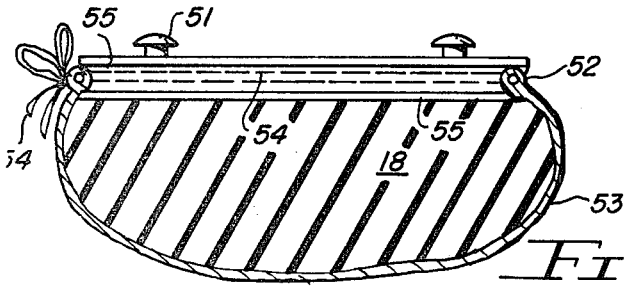

An optional method of connecting circular pad 23 to rubber disk 15 is illustrated in FIGS. 7 and 8. Keyhole apertures 50 detachably fixedly receive pins 51 attached to circular plate 20. Plate 20 is provided with peripheral groove 55 which receives lip 52 of replaceable cloth bag 53. String 54, which passes through lip 52 of bag 53 is drawn tight and tied to secure lip 52 in groove 55. Circular plates 15, 20 can be formed from a rigid metal or similar material, but fabricating the plates from rubber supplements the ability of pad 23 to adapt to and conform to the various surface contours of a bathtub.

Having described my invention in such terms as to enable those skilled in the art to understand and practice it, and having identified the presently preferred embodiments thereof,

I claim:

1. A manually manipulated tool for cleaning a bathtub, said tool enabling an individual to readily reach and clean inner vertical and horizontal surfaces of the bathtub while standing adjacent thereto, and requiring a minimal amount of exertion on the part of and being easily manipulated by an individual utilizing said tool, said tool comprising, (a) a cleaning head including a rotary circular pad for contacting and cleaning the inner surfaces of said bathtub, said circular pad being resiliently compressible to facilitate said cleaning head's adapting to and traversing the inner curved surfaces of said bathtub, said cleaning head having an operative position in which (i) said cleaning head is oriented with said rotary circular pad resting on a generally horizontal bathtub surface, and (ii) said cleaning head includes a point representing the center of gravity thereof, said point lying along an imaginary vertical axis passing through said cleaning head and perpendicular to said horizontal bathtub surface when said cleaning head is oriented in said operative position;

(b) an elongate rod having a first end including a handle, center portion and second end, said second end being pivotally attached to said cleaning head at a point generally lying along said imaginary vertical axis passing through said cleaning head such that when said cleaning head is raised from said horizontal surface into the air the orientation of said head with respect to said imaginary vertical axis remains generally fixed, said vertical axis being perpendicular to said horizontal surface of said bathtub;

(c) releasable locking means including (i) cooperating means between said second end of said rod and said head for releasably locking said head in a plurality of fixed positions with respect to said second end to prevent pivotal movement of said second end with respect to said head, and (ii) adjustment means extending through said elongate rod between said cooperating means and said handle to enable the control from said handle of said cooperating means to position said head in said plurality of fixed positions; and (d) motor means integrated in said tool for supplying motive power to drive said rotary circular pad and including a depending rotatable member for carrying said circular pad and imparting motive power thereto.

2. The total of claim 1 wherein said locking means has at least two operative positions:

(a) a first operative position with said head locked in one of said fixed positions with respect to said second end of said elongate rod; and, (b) a second disengaged operative positive with said head free to pivot on said second end of said elongate rod.

3. The tool of claim 2 wherein said locking means is manually operated.

4. The tool of claim 3 wherein said locking means remains in said second operative position when an individual ceases application of manual force to said locking means.

5. The tool of claim 2 inluding a second handle attached to said center portion of said elongate rod.

6. The tool of claim 5 wherein the center of gravity of said tool is located in said center portion of said elongate rod such that when an individual is utilizing said tool by grasping said second handle with one hand and said first handle with the other hand, said second handle functions as a fulcrum and the manual application of relatively minor displacement forces to said first handle readily causes said tool to pivot about said hand holding said second handle.

7. The tool of claim 6 wherein said second end of said elongate rod is curved.

8. The tool of claim 6 wherein said point at which said second end is attached to said cleaning head lies at or above said center of gravity of said cleaning head when said cleaning head is in said operative position.

9. The tool of claim 8 where said elongate rod is shaped, contoured and dimensioned to allow an individual grasping said handle and standing alongside said bathtub to apply said rotary pad of said cleaning head to said inner vertical and horizontal surfaces of said bathtub.

* * * * *